United States Patent [19]

Perkins

[11] Patent Number: 4,572,578

[45] Date of Patent: Feb. 25, 1986

[54] BACK REST

[76] Inventor: Patricia A. Perkins, 118 S. Fairacres Rd., Las Cruces, N. Mex. 88005

[21] Appl. No.: 638,757

[22] Filed: Aug. 8, 1984

[51] Int. Cl.[4] ..... A47C 7/02

[52] U.S. Cl. ..... 297/460; 5/432

[58] Field of Search ..... 297/460, 453, 464; 5/432, 448

[56] References Cited

U.S. PATENT DOCUMENTS

| | | | |
|---|---|---|---|
| 1,673,433 | 6/1928 | Wheeler et al. | 297/460 X |
| 1,937,920 | 12/1933 | Smith | 297/460 X |
| 2,970,638 | 2/1961 | Halter | 297/460 X |
| 3,361,471 | 1/1968 | Radford | 297/460 X |
| 3,606,464 | 9/1971 | Arbuthnot | 297/460 |
| 4,189,182 | 2/1980 | Rhoe | 297/230 X |
| 4,300,249 | 11/1981 | Taylor | 297/460 X |
| 4,383,713 | 5/1983 | Roston | 297/464 X |
| 4,500,133 | 2/1985 | Nakao | 297/464 X |
| 4,535,495 | 8/1985 | Oldfield | 5/432 |

*Primary Examiner*—James T. McCall

*Attorney, Agent, or Firm*—Edward B. Gregg

[57] ABSTRACT

Back rest having a semi-rigid frame having the shape, in longitudinal section, of a shallow S formed by an upper concave portion and a lower convex portion, a cervical support affixed to and projecting from the upper end of the frame, a thoracic support extending downwardly from the cervical support along the median line of the frame, a lumbo-sacral support extending downwardly from the thoracic support, said thoracic and lumbo-sacral supports being formed with a groove to receive bony spinal prominences, and a kidney support on each side of that frame, said supports being of foam material.

7 Claims, 6 Drawing Figures

BACK REST

This invention relates to a back rest.

Back rests intended to provide support and comfort for a person seated in a chair, in the seat of an automobile, or elsewhere should provide not only comfort but also provide support for the thoracic, cervical and lumbo-sacral areas and, while providing comfort, should also assist in maintaining correct posture.

Heretofore back supports, at least those of relatively simple design, do not properly accomplish all of these objectives.

It is an object of the present invention to provide a back support which is relatively simple in its construction and inexpensive to fabricate.

It is another object of the invention to provide a back support which affords comfort and maintains proper posture in the cervical, thoracic and lumbo-sacral areas.

The above and other objects of the invention will be apparent from the ensuing description and the appended claims.

One embodiment of the invention is illustrated by way of example in the accompanying drawings in which.

Figure 1A:
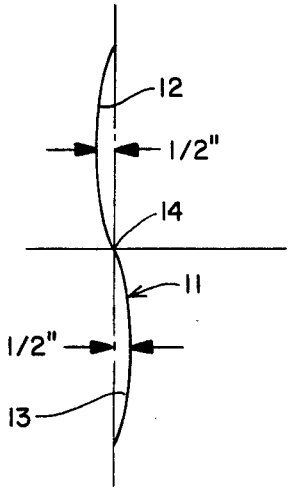
FIG. 1A is an edge view (as seen from the left of FIG. 1B) of the semi-rigid frame.
Figure 1B:
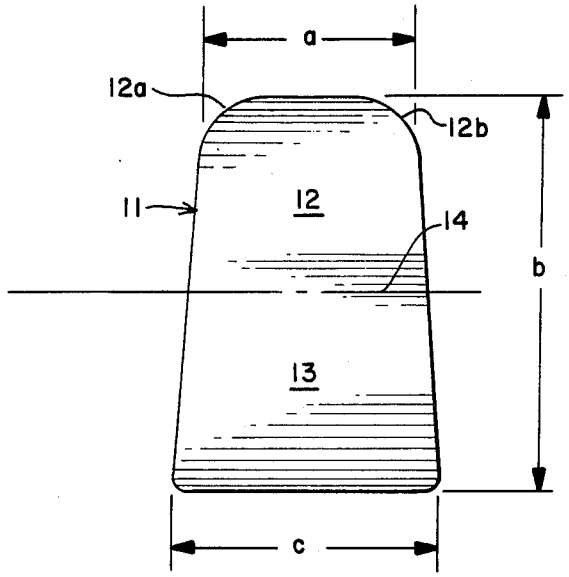
FIG. 1B is a front view of the frame.
Figure 2:
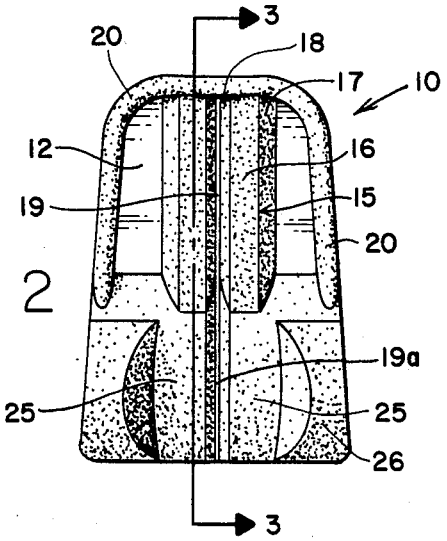
FIG. 2 is a front view of the back support with the inner foam plastic portions exposed but without the outer covering, which is shown in FIG. 5.

Referring now to the drawings, the back rest in its entirety (but without the outer cover) is shown in FIG. 2 and is designated by the reference numeral 10. It comprises a somewhat rigid frame member 11, which may be made of aluminum or hard plastic material which is resilient but which nevertheless provides a firm support and framework for the back rest. As shown in FIG. 1A the frame 11 has a shallow S-shape including an upper concave (as viewed from the front) portion 12, a lower convex (as viewed from the front) portion 13, and an inflection line at 14 between the upper and lower portions 12 and 13. The departure from a vertical plane is advantageously one-half inch as indicated, although this may be varied according to particular desires and the size and physical deformities (if any) of the person using the back rest. As will be seen in FIG. 1B the frame 11 tapers from the bottom to the top and the top portion 12 has rounded shoulders at 12*a* and 12*b*.

In the thoracic region two foamed plastic supports 15 are provided which are trapezoidal in cross-section, having an outer surface 16 conforming to the curvature of the upper portion 12 of the frame and sloping side portions 17 and 18. These members are shown as they would be if cut from a solid piece of foam material. They may, however, be molded in which event the side portions 17 and 18 may have a curvature.

The two thoracic members 15 are spaced apart to provide a slot or groove 19 between them, the purpose of which is to receive and accommodate bony prominences of the spine.

A generally U-shaped member 20 is provided, also of plastic foam material, the upper portion of which is raised at 21 (see FIG. 3) to provide a cervical support area. The raised portion 21 may be glued onto the U-shaped member 20 or the entire structure may be molded in one piece.

Figure 3:
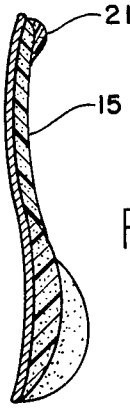
FIG. 3 is a section taken along the line 3—3 of FIG. 2.
Figure 4:
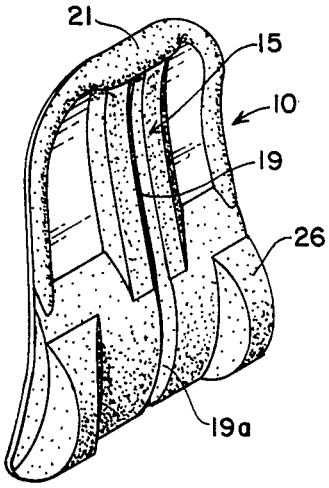
FIG. 4 is a perspective view of the uncovered back rest shown in FIG. 2.

Referring now to FIGS. 3 and 4, as well as FIG. 2, lumbo-sacral support members of plastic foam material are provided at 25 which have the curvature of the lower portion 13 of the frame 11 and they are spaced apart to provide a continuation 19*a* of the groove 19. Along the outer side of each member 25 is a pillow-like support member 26. These provide kidney support.

Figure 5:
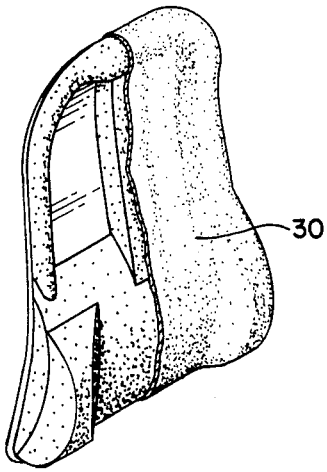
FIG. 5 is a perspective showing the outer cover.

As will be seen in FIG. 5, the entire structure shown in FIGS. 2 and 4 is covered with an outer layer 30 of plastic foam material. Only one-half of this is shown; the other half being identical. Preferably, although not necessarily, this cover extends around the rear of the frame 11. A fabric outer slip cover (not shown) may also be provided which can be removed, laundered and replaced.

Preferably the plastic supports are of different densities and stiffness suited for their particular uses. Open cell polyurethane foam is a preferred foam material. The kidney supports may be of lesser density and stiffness, No. 1334 on the usual scale, the cervical, thoracic and lumbo-sacral supports are greater density and stiffness, e.g., No. 3030 for small size, No. 2034 for medium size and No. 1445 for large size. The cover 30 is least dense and stiff.

There is thus provided a back support which supports the cervical, thoracic and lumbo-sacral areas of a person's body and in which a longitudinal groove is provided to avoid discomfort by reason of bony prominences of the spine. The neck of the person using the back rest is held in proper position as well as other parts of the body. The back rest can be used by a person lying down or seated in a chair, automobile seat, etc.

What is claimed is:

1. A back rest comprising:

(a) a frame having a front surface, a rear surface, an upper portion defining a cervical-thoracic area and a lower portion defining a lumbo-sacral area, said upper portion being concave and said lower portion being convex as viewed from the front, said frame having the shape of a shallow S in vertical section, (b) a cervical support affixed to and projecting forwardly from the upper end of the upper portion of the frame, (c) a thoracic support affixed to the frame and extending forwardly therefrom and downwardly from the cervical support along the longitudinal median line of the frame, said support being formed with a groove along its midline to receive bony spinal prominences, (d) a lumbo-sacral support affixed to and extending forwardly from the lower part of the frame and downwardly from the thoracic support, said lumbo-sacral support having a groove which forms a continuation of the groove in the thoracic support, said supports being of resilient material.

2. The back rest of claim 1 including a kidney support affixed to the lower portion of the frame on each side thereof, said supports projecting outwardly from the lumbo-sacral support and being spaced apart to accommodate the lumbo-sacral portion of a person resting against or reclining against the back rest, said kidney supports being also of resilient material.

3. The back support of claim 2 wherein said supports are of plastic foam material.

4. The back support of claim 3 wherein the cervical support is formed by the upper portion of an inverted U, the side portions of the U being affixed to the upper portion of the frame along opposite sides thereof.

5. A back rest comprising:

(a) a frame having a front surface, a rear surface, an upper portion defining a cervical-thoracic area and a lower portion defining a lumbo-sacral area, said upper portion being concave and said lower portion being convex as viewed from the front, said frame having the shape of a shallow S in vertical section, (b) a thoracic support affixed to the frame and extending forwardly therefrom and downwardly from the upper end of and along the longitudinal median line of the frame, said support being formed with a groove along its midline to receive bony spinal prominences, (c) a lumbo-sacral support affixed to and extending forwardly from the lower part of the frame and downwardly from the thoracic support, said lumbo-sacral support having a groove which forms a continuation of the groove in the thoracic support, said supports being of resilient material.

6. The back rest of claim 5 including a kidney support affixed to the lower portion of the frame on each side thereof, said supports projecting outwardly from the lumbo-sacral support and being spaced apart to accommodate the lumbo-sacral portion of a person resting against or reclining against the back rest, said kidney supports being also of resilient material.

7. The back support of claim 6 wherein said supports are of plastic foam material.

* * * * *